US008697177B2

(12) United States Patent
Bolognini

(10) Patent No.: US 8,697,177 B2
(45) Date of Patent: Apr. 15, 2014

(54) METHOD FOR VARNISHING SECURITY DOCUMENTS, ESPECIALLY INTAGLIO-PRINTED SECURITY DOCUMENT SUCH AS BANKNOTES, AND VARNISHING MACHINE FOR CARRYING OUT THE SAME

(75) Inventor: Stéphane Bolognini, Lausanne (CH)

(73) Assignee: KBA-Notasys SA, Lausanne (CH)

( * ) Notice: Subject to any disclaimer, the term of this patent is extended or adjusted under 35 U.S.C. 154(b) by 414 days.

(21) Appl. No.: 13/059,040

(22) PCT Filed: Aug. 18, 2009

(86) PCT No.: PCT/IB2009/053638

§ 371 (c)(1), (2), (4) Date: Feb. 14, 2011

(87) PCT Pub. No.: WO2010/023598

PCT Pub. Date: Mar. 4, 2010

(65) Prior Publication Data

US 2011/0146510 A1 Jun. 23, 2011

(30) Foreign Application Priority Data

Aug. 29, 2008 (EP) ..... 08105185

(51) Int. Cl.
*B41M 3/14* (2006.01)
*B44F 1/12* (2006.01)

(52) U.S. Cl.
USPC ..... 427/7

(58) Field of Classification Search
USPC ..... 427/7; 101/232
See application file for complete search history.

(56) References Cited

U.S. PATENT DOCUMENTS

| | | | |
|---|---|---|---|
| 2,659,305 | A | 11/1953 | Giori |
| 4,516,496 | A | 5/1985 | Giori |
| 4,821,643 | A | 4/1989 | Wieland |
| 4,830,902 | A | 5/1989 | Plantenga et al. |
| 5,062,359 | A | 11/1991 | Giori |

(Continued)

FOREIGN PATENT DOCUMENTS

| | | |
|---|---|---|
| CA | 2 446 559 | 11/2002 |
| CA | 2 552 634 | 8/2005 |

(Continued)

OTHER PUBLICATIONS

Buitelaar, Tom, "Circulation Fitness Management," De Nederlandsche Bank NV, Amsterdam, the Netherlands, Banknote 2003 Conference, Washington DC, Feb. 3, 2003, 54 pages.

(Continued)

*Primary Examiner* — Kelly M Gambetta
(74) *Attorney, Agent, or Firm* — Seager, Tufte & Wickhem LLC

(57) ABSTRACT

There is described a method for varnishing security documents, especially intaglio-printed security documents such as banknotes, wherein both sides of the security documents are covered by a protective varnish. The method comprises the step of applying a thicker layer of protective varnish on a side of the security documents which exhibits a greater surface roughness, especially the side which is opposite to the side of the security documents which was last printed by intaglio printing. Also described in a varnishing machine for carrying out the above method.

23 Claims, 5 Drawing Sheets

(56) References Cited

U.S. PATENT DOCUMENTS

| | | | | |
|---|---|---|---|---|
| 5,062,360 | A | 11/1991 | Germann et al. | |
| 5,186,107 | A | 2/1993 | Wieland | |
| 5,899,145 | A | 5/1999 | Schaede | |
| 6,685,185 | B2 | 2/2004 | Gunter | |
| 2002/0127339 | A1 | 9/2002 | Schwitzky et al. | |
| 2002/0190462 | A1 | 12/2002 | Peter | |
| 2004/0069169 | A1 * | 4/2004 | Demaimay et al. | 101/232 |
| 2004/0232108 | A1 | 11/2004 | Giori | |
| 2006/0043729 | A1 | 3/2006 | Schwitzky et al. | |
| 2007/0017647 | A1 | 1/2007 | Habik et al. | |
| 2007/0181016 | A1 | 8/2007 | Schaede | |
| 2008/0017057 | A1 | 1/2008 | Gieser et al. | |
| 2009/0038490 | A1 | 2/2009 | Gygi | |
| 2009/0223927 | A1 | 9/2009 | Giori et al. | |

FOREIGN PATENT DOCUMENTS

| | | | |
|---|---|---|---|
| CH | 289716 | | 7/1953 |
| CH | 373770 | | 1/1964 |
| CH | 477293 | | 1/1969 |
| DE | 1 058 074 | | 5/1959 |
| EP | 0 091 709 | | 10/1983 |
| EP | 0 256 170 | | 2/1988 |
| EP | 0 311 924 | | 4/1989 |
| EP | 0 406 157 | | 1/1991 |
| EP | 0 415 881 | | 3/1991 |
| EP | 0 527 424 | | 2/1993 |
| EP | 0 873 866 | | 10/1998 |
| EP | 1 256 447 | | 11/2002 |
| EP | 1 880 845 | | 1/2008 |
| EP | 1 932 678 | | 6/2008 |
| GB | 987102 | | 3/1965 |
| IN | 118869 | | 8/1969 |
| JP | 2007-176044 | | 7/2007 |
| WO | 01/08899 | | 2/2001 |
| WO | 02/051638 | | 7/2002 |
| WO | WO 02/051638 | A * | 7/2002 |
| WO | WO 02051638 | A1 * | 7/2002 |
| WO | 02/094577 | | 11/2002 |
| WO | 03/103962 | | 12/2003 |
| WO | 2004/072378 | | 8/2004 |
| WO | 2005/077656 | | 8/2005 |
| WO | 2005/118294 | | 12/2005 |
| WO | 2006/021856 | | 3/2006 |

OTHER PUBLICATIONS

Buitelaar, Tom, "Effects of Banknote Varnishing," De Nederlandsche Bank NV, Amsterdam, the Netherlands, Currency Conference CSI, Sydney (1999) 4 pages.

De Heij, Hans A.M., "The Design Methodology of Dutch Banknotes," SPIE vol. 3973, Jan. 27-28, 2000, 22 pages.

Wettstein, Frank, "Life Cycle Assessment (LCA) of Swiss Banknotes," Cash Division, Swiss National Bank, Berne and Hubert Lieb, Environmental Unit, Swiss National Bank, Zurich, Quarterly Bulletin Mar. 2000 of the Swiss National Bank, Sep. 2000, 15 pages.

* cited by examiner

METHOD FOR VARNISHING SECURITY DOCUMENTS, ESPECIALLY INTAGLIO-PRINTED SECURITY DOCUMENT SUCH AS BANKNOTES, AND VARNISHING MACHINE FOR CARRYING OUT THE SAME

TECHNICAL FIELD

The present invention generally relates to the field of security printing, and more particular to the varnishing of security documents, especially of intaglio-printed security documents such as banknotes.

BACKGROUND OF THE INVENTION

It is now common in the art of security printing, especially in the context of the production of banknotes, to apply protective layers of varnish on security documents with a view to increase their life time.

Varnishing of banknotes was and is especially carried out to increase the durability of banknotes put into circulation. Information about the varnishing of banknotes can for instance be found in the following papers:

[Buitelaar1999]:

Tom Buitelaar, De Nederlandsche Bank NV, Amsterdam, the Netherlands, "Effects of Banknote varnishing", Currency Conference CSI, Sydney 1999;

[deHeij2000]:

Hans A. M. de Heij, De Nederlandsche Bank NV, Amsterdam, the Netherlands, "The design methodology of Dutch banknotes", IS&T/SPIE's 12$^{th}$ International Symposium on Electronic Imaging, Optical Security and Counterfeit Deterrence Techniques III, San Jose, Calif., USA (Jan. 27-28, 2000), Proceedings of SPIE vol. 3973, pp. 2-22;

[Wettstein2000]:

Frank Wettstein, Cash Division, Swiss National Bank, Berne and Hubert Lieb, Environmental Unit, Swiss National Bank, Zurich, "Life cycle assessment (LCA) of Swiss banknotes", Quarterly Bulletin 3/2000 of the Swiss National Bank, September 2000;

[Buitelaar2003]:

Tom Buitelaar, De Nederlandsche Bank NV, Amsterdam, the Netherlands, "Circulation Fitness Management", Banknote 2003 Conference, Washington D.C., Feb. 3, 2003;

Further information about the varnishing of banknotes and like security documents might be found in European patent application Nos. EP 0 256 170 A1, EP 1 932 678 A1 and International application Nos. WO 01/08899 A1, WO 02/094577 A1, WO 2004/072378 and WO 2006/021856 A1.

International application No. WO 02/051638 A1 discloses a flexographic printing press suitable for carrying out varnishing on the recto and verso sides of security documents, such as banknotes. This flexographic printing press is in particular characterized in that flexographic printing units are disposed above and below the path of the sheets being varnished. Recto-verso varnishing is thus carried out without this necessitating reversal of the sheets during processing thereof.

Japanese patent application No. JP 2007-176044 A discloses a recto-verso offset printing press equipped with a varnishing system for recto-verso varnishing of the printed sheets. European patent application No. EP 1 880 845 A2 similarly discloses a recto-verso offset printing press equipped with coating units for recto-verso varnishing of the printed sheets.

The varnishing of banknotes is also commonly performed on so-called polymer banknotes, which polymer banknotes are characterized by an all-plastic transparent polymer substrate (typically a BOPP—biaxially oriented polypropylene—laminate) with white opacifying layers provided on both sides thereof.

Varnishing has demonstrated its value as an efficient way of increasing the durability and life time of banknotes and like security documents. Nevertheless, it has been noticed that varnished banknotes were still prone to soiling and that the varnishing process still needs to be improved.

It has in particular been noticed that intaglio-printed security documents, even though varnished on both sides, still needed to be improved in terms of their resistance to soiling. Furthermore, it has been noticed that intaglio-printed security documents were more likely to get soiled on one side than on the other.

Intaglio printing is a well-known printing process that is especially used for the production of security documents. Information about intaglio printing and intaglio printing presses for carrying such a printing process may be found in Swiss patents No. CH 289 716, CH 373 770, CH 477 293, German patent DE 1 058 074, European patent applications Nos. EP 0 091 709 A1, EP 0 406 157 A1, EP 0 415 881 A2, EP 0 873 866 A1, and International application Nos. WO 03/103962 A1, WO 2005/077656 A1 and WO 2005/118294 A1, all in the name of the present Applicant.

SUMMARY OF THE INVENTION

A general aim of the invention is therefore to provide an improved method for varnishing printed security documents, especially intaglio-printed security documents.

A further aim of the invention is to provide such a method that enables an efficient use of varnish while guaranteeing optimum varnishing efficiency.

Still another aim of the invention is to provide a method that achieves optimum varnishing of both sides of printed security documents.

Yet another aim of the invention is to provide a method that can be carried out easily on a suitable varnishing machine.

These aims are achieved thanks to the method defined in the claims.

There is accordingly provided a method for varnishing intaglio-printed security documents, especially intaglio-printed banknotes, wherein both sides of the security documents are covered by a protective varnish, the method comprising the step of applying a thicker layer of protective varnish on a side of said security documents which is opposite to the side of the security documents which was last printed by intaglio printing.

There is also provided a method for varnishing printed security documents, especially banknotes, wherein both sides of the security documents are covered by a protective varnish and wherein a first side of the security documents exhibits a surface roughness at least 10 microns higher than that of the second side, the method comprising the step of applying a thicker layer of protective varnish on the first side of the security documents. In this context, the higher surface roughness of the first side of the security documents might especially be caused by the manufacturing process of the substrate onto which the security documents are printed.

The said thicker layer of protective varnish may be applied in one step onto the side of the security documents or, alternately, in two or more steps.

Preferably, the security documents are varnished in such a way that both sides of the security documents exhibit substantially the same surface roughness after varnishing.

Thanks to the invention, optimum use of varnish is ensured, while guaranteeing that both sides of the security documents will exhibit a comparable resistance to soiling.

Optionally, a primer might be applied on at least one side of the security documents prior to applying the protective varnish.

There is also claimed a varnishing machine for varnishing both sides of printed security documents, especially intaglio-printed security documents such as banknotes, wherein the varnishing machine is adapted to apply a thicker layer of protective varnish on a side of the security documents than on the other side. This varnishing machine is advantageously designed to varnish successive sheets carrying security imprints that ultimately form the security documents.

According to a first variant of this machine, a first coating unit might be provided for varnishing a first side of the security documents in one step and a second coating unit might be provided for varnishing the second side of the security documents in one step, the first or second coating unit being designed to apply a greater thickness of protective varnish than the other coating unit.

According to another variant of this machine, a first coating unit might be provided for varnishing a first side of the security documents and a second coating unit might be provided for varnishing the second side of the security documents, the varnishing machine further comprising a third coating unit for applying an additional layer of protective varnish or a primer on the first or second side of the security documents.

Preferably, such varnishing machine is designed to perform varnishing by flexographic printing.

Further advantageous embodiments of the invention form the subject-matter of the dependent claims and are discussed below.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

DETAILED DESCRIPTION OF EMBODIMENTS OF THE INVENTION

In the context of the present invention, "protective varnish" shall be understood as referring to any type of varnish, coating or like protective material that may be applied onto the surface of a printed document by a printing process. Such protective varnishes may be transparent or slightly coloured and be more or less matt or glossy depending on the application and may further incorporate security features, for instance fluorescent pigments that may become visible under UV light.

The protective varnishes may furthermore be any type of aqueous varnishes which are dried by infrared/thermal radiation (which aqueous varnishes for instance consist of 40% solid content that remains on the varnished product and 60% of aqueous solution which is evaporated as a result of drying) or UV-cured varnishes which are cured by ultraviolet radiation (which UV-cured varnishes typically consist of 100% solid content that remains on the varnished product following curing).

The present invention stems from the understanding that the difference between the two sides of intaglio-printed documents in terms of resistance to soiling is a direct consequence of the intaglio printing process, as discussed herebelow. This observation is also valid for printed security documents in general where a difference between the two printed sides in terms of resistance to soiling is due to other factors than intaglio printing, such as the manufacturing process that was used to produce the substrate onto which the security documents are printed.

Figure 1:
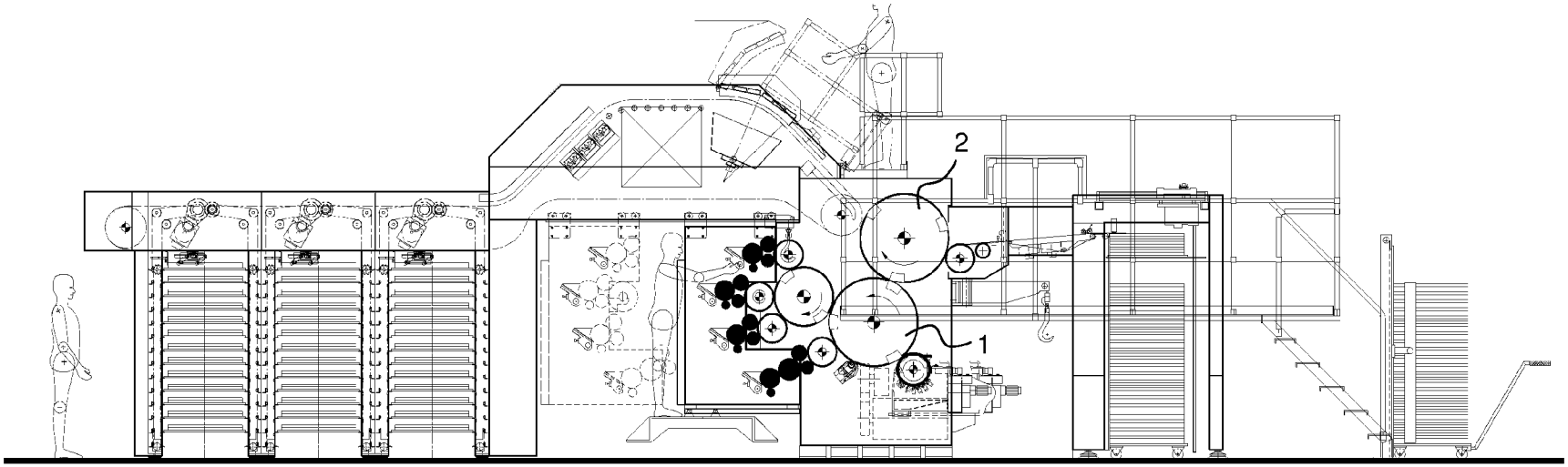
FIG. 1 is a schematic side view of a known sheet-fed intaglio printing press as used for the production of security documents.

Intaglio printing is characterized by high printing pressures applied at the time of printing between the hard surface of an intaglio printing plate which carries the ink pattern to be transferred onto the substrate to be printed and the much softer surface of a blanket that is applied on the opposite side of the substrate. Thanks to this arrangement, the substrate material is pushed into the depressions of the intaglio printing plate to catch the ink contained therein and plastically deforms in the process, thereby leading to characteristic embossed reliefs with ink patterns thereon, which embossed reliefs are typical of intaglio printing. In operation, successive sheets or portions of a continuous web of material is fed to the printing nip defined between a plate cylinder carrying one or more intaglio printing plates and an impression cylinder (or counter-pressure cylinder) carrying one or more blankets. FIG. 1 is a schematic illustration of a known sheet-fed intaglio printing press as marketed by the present Applicant under the designation Super Orlof Intaglio® where the plate cylinder and the impression cylinder are designated by reference numerals 1 and 2, respectively.

As mentioned, intaglio printing plates carried by the plate cylinder 1 typically exhibit a very hard surface, the plates being conventionally made of a metallic base material, such as nickel, steel or brass, which base material is further provided with a wear-resistant coating such as a chromium layer. In comparison, the blankets carried by the impression cylinder are made of a soft compressible material, such as a textile or rubber material as manufactured by company I.T.G.-GmbH Graphic Products (http://www.itg-graph.de), which blanket material is typically disposed on top of one or more packing sheets made for instance of cardboard. In terms of surface roughness, the intaglio printing plates exhibit a very smooth surface, while the impression blankets provided on the impression cylinder exhibit a considerably rougher surface.

Due to the difference in terms of surface properties between the intaglio printing plates and the impression blankets, there results a difference in the surface roughness of the printed substrate between the front and reverse sides thereof, the surface of the printed substrate becoming rougher on the side opposite the side of the printed substrate which was last printed by intaglio-printing.

Figure 2A:
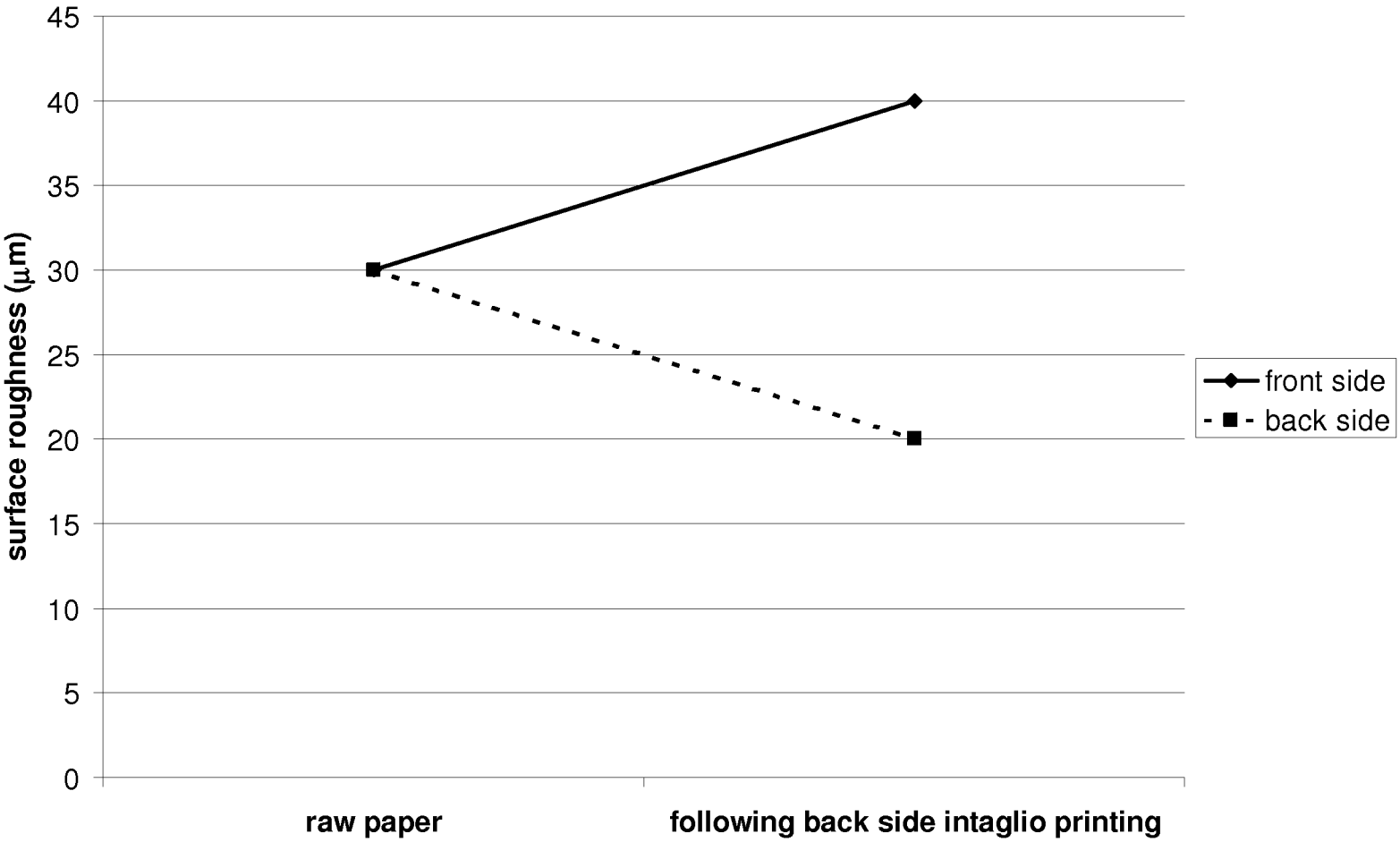
FIGS. 2*a* and 2*b* are schematic diagrams illustrating an example of evolution of the surface roughness of the back side and front side of intaglio printed documents.
Figure 2B:
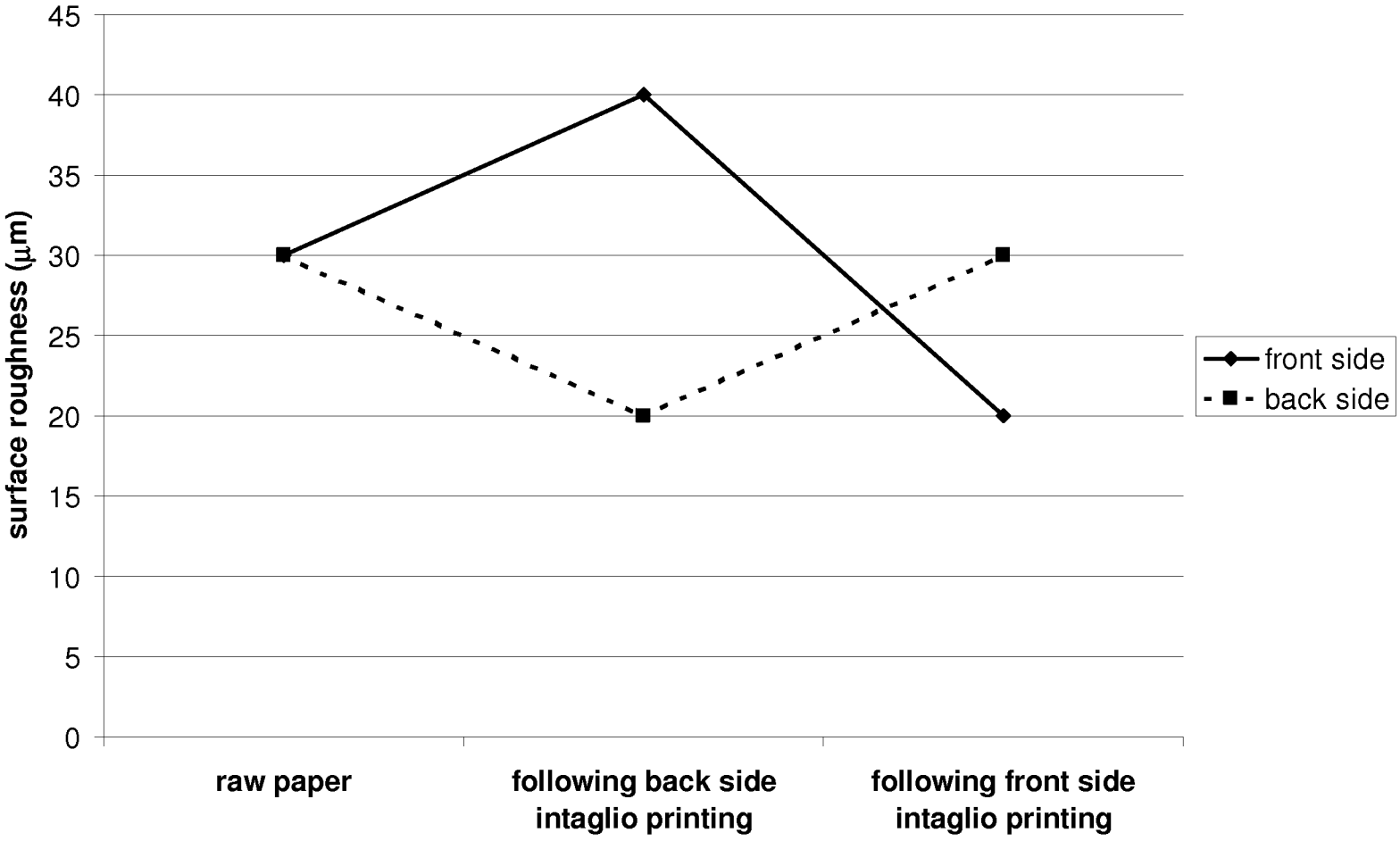

FIGS. 2*a* and 2*b* are schematic diagrams illustrating an example of evolution of the surface roughness of the back side and front side of intaglio printed documents using a typical cotton paper as substrate material. FIG. 2*a* illustrates the case of single-side intaglio printing where only the back side is printed by intaglio printing, while FIG. 2*b* illustrates the case of double-side intaglio printing where the back side and front side are printed one after the other by intaglio printing.

In FIGS. 2*a* and 2*b*, the raw paper used as substrate material for the intaglio printing process exhibits an initial surface roughness, for instance of the order of 30 microns on both sides. Differences in terms of surface roughness may be noticed between both sides of the unprinted substrate, depending on the type of substrate material and the process used for its manufacture. For the purpose of the below explanation, it will be considered that both sides of the unprinted paper exhibit more or less the same surface roughness before intaglio printing. It is however to be understood that the invention is also applicable in case there exists a substantial difference in terms of surface roughness between the two sides of the security documents which may be caused by the manufacturing process of the substrate onto which the security documents are printed.

Following intaglio printing of the back side, it can be noticed that the surface roughness of the back side (i.e. the printed side oriented towards the intaglio printing plate) decreases, for instance to approx. 20 microns, while the surface roughness of the front side (i.e. the unprinted side oriented towards the impression blanket) increases, for instance to approx. 40 microns (the height of the intaglio patterns produced on the substrate as a result of the intaglio printing process are not considered in the above roughness estimations). The same phenomenon may be noticed following intaglio printing of the front side as illustrated in FIG. 2*b*, where the surface roughness of the back side increases, for instance to approx. 30 microns, while the surface roughness of the front side decreases, for instance to approx. 20 microns.

The diagrams of FIGS. 2*a* and 2*b* are purely illustrative, the exact evolution of the surface roughness of the back and front sides depending on different factors, including the type of substrate material, the nature of the blanket material, printing pressure, etc. There is however a common aspect in all surface roughness evolutions, namely the fact that the surface roughness of the side which was last printed by intaglio printing is lower than the surface roughness of the opposite side (i.e. the side last brought into contact with the impression blanket becomes rougher than the side that was brought into contact with the intaglio printing plate).

According to the present invention, account is taken of this fact by providing that a thicker layer of protective varnish is applied on the side of intaglio-printed security documents which is opposite to the side of the security documents which was last printed by intaglio printing.

From a more general point of view, this approach is also and advantageously applicable for the varnishing of printed security documents (whether or not printed by intaglio printing) where a first side of the security documents exhibits a surface roughness at least 10 microns higher than that of the second side, especially in the case of security documents that are printed onto a substrate the manufacturing process of which causes the first side of the security documents to exhibit a higher surface roughness than the second side.

Preferably, the security documents are varnished in such a way that both sides of the security documents exhibit substantially the same surface roughness after varnishing.

The adequate amount of varnish to be applied on each side of the security documents will depend on the particular case, but may be determined by measuring the surface roughness of both sides of the security documents prior to varnishing and adjusting the quantities of varnish in dependence thereof. Typical quantities of applied varnish are of the order of 2 to 2.8 grams per $m^2$ dry in case of UV-cured varnishes (100% of solid content) and of the order of 1.5 to 2.8 grams per $m^2$ dry in case of aqueous varnishes (40% of solid content), which quantities are given for the purpose of illustration only.

According to the invention, the rougher side of the security documents, for instance the side opposite the side which was last printed by intaglio printing, requires a greater amount of varnish than the other side to yield similar surface roughness values after varnishing.

Tests have shown (see again FIGS. 2*a* and 2*b*) that the surface roughness of the side which was last printed by intaglio printing is typically of the order of 20 microns in case of a typical cotton paper, approximately 10 to 20 microns lower than the opposite, rougher side. It is estimated that the side of the security documents which was last printed by intaglio printing may require up to 30% less of varnish quantities as compared to the opposite side in the case of a cotton paper, which leads to non-negligible savings in terms of varnish consumption.

The thicker layer of protective varnish may be applied in one step onto the side of the security documents or, alternately, in two or more steps.

Figure 3:
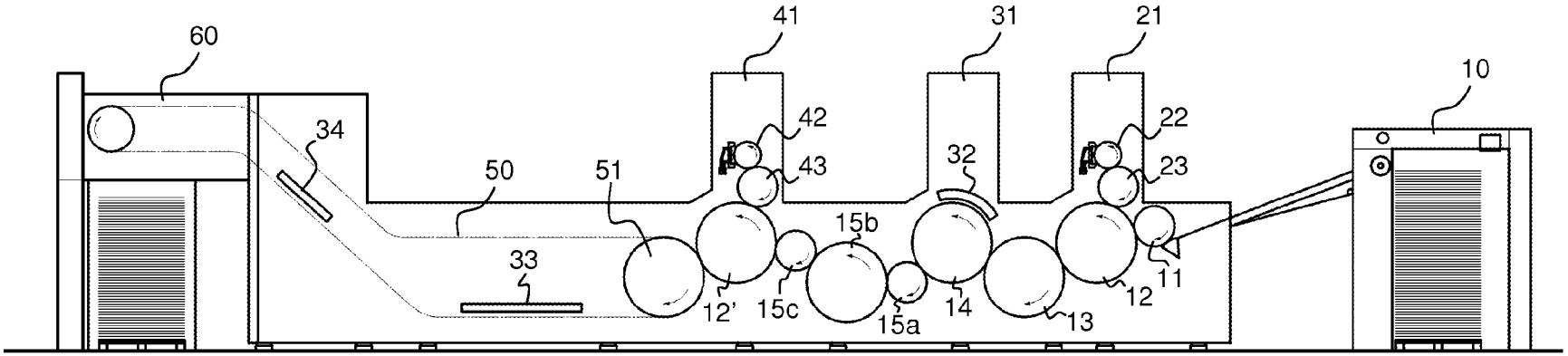
FIG. 3 is a schematic side view of a sheet-fed varnishing machine according to one embodiment of the invention.

FIG. 3 shows a first embodiment of a varnishing machine which is advantageously designed to varnish successive sheets carrying security imprints that ultimately form the security documents and to apply the thicker layer of protective varnish in one step.

As is typical in the art, the varnishing machine comprises a feeder unit 10 for feeding successive sheets to be varnished, which sheets are fed in sequence through a plurality of coating and drying/curing towers 21, 31, 41 and then delivered to a delivery unit 60 by means of a conventional chain conveyor system 50 with gripper bars (not shown) for holding the leading edge of the varnished sheets.

In the example of FIG. 3, the varnishing machine comprises a first coating tower 21 including a first coating unit 22, 23 for varnishing the front side of the sheets, a drying/curing tower 31 for drying, or respectively curing, the front side of the sheets that has been varnished in the first tower 21, a perfecting unit 15*a*-15*c* for reversing the sheets and a second coating tower 41 comprising a second coating unit 42, 43 for varnishing the back side of the sheets.

The coating units 22, 23 and 42, 43 are preferably flexographic units comprising an anilox roller 22, respectively 42, the cells of which are filled by a suitable ink chamber, which anilox roller 22, 42 cooperates with a forme cylinder 23, respectively 43, carrying a flexographic printing plate.

The sheets are transported from the feeder unit 10 onto a feeder table (not referenced) so as to be properly aligned before being fed to the first coating tower 21 by means of a suitable sheet infeed arrangement comprising, in this example, a swing arm (not referenced) placed downstream of the feeder table for transferring individual sheets in sequence to a feed drum 11. This feed drum 11 transfers the sheets to a first impression cylinder 12 which cooperates with the flexographic forme cylinder 23 of the first coating unit. Once varnished, the sheets are transferred from the impression cylinder 12 to a transfer cylinder or drum 13 and then to a processing cylinder 14 of the drying/curing tower 31. A suitable drying or curing system 32 (such as an infrared/thermal system or a UV system) is provided along the passage of the sheets that are transported by the processing cylinder 14 to dry, respectively cure, the varnish applied on the first side of the sheets.

The sheets are then transferred to the perfecting unit 15*a*-15*c* which consists in this example of a three-drum arrangement, namely a transfer drum 15*a*, a storage drum 15*b* and a turning drum 15*c*, as is known in the art (see e.g. European patent applications Nos. EP 0 311 924 A2, EP 0 527 424 A1 and EP 1 256 447 A2). Reversal of the sheets happens upon transfer of the sheets from the storage drum 15*b* to the turning drum 15*c*, the turning drum 15*c* being designed to seize the trailing edge of the sheets being transported by the storage drum 15*b* before the sheets are released therefrom.

Once reversed, the sheets are transferred from the turning drum 15*c* in the usual manner to a second impression cylinder 12' cooperating with the flexographic forme cylinder 43 of the second coating unit. Once varnished on their second side, the sheets are transferred from the impression cylinder 12' to the transfer drum 51 of the chain conveyor system 50. Drying/curing of the second side of the sheets is performed by one or more additional drying/curing systems 33, 34 placed along the path of the chain conveyor system 50 as illustrated.

The weight of the varnish applied by each coating unit is determined by the cell capacity of each anilox roller 22, 42. In order to apply a greater quantity of varnish on one or the other side of the sheets, the corresponding anilox roller 22 or 42 shall be designed to exhibit a greater cell capacity than the other anilox roller. In other words, either the first or the second coating unit in FIG. 3 is designed to apply a greater thickness of protective varnish than the other coating unit.

Figure 4:
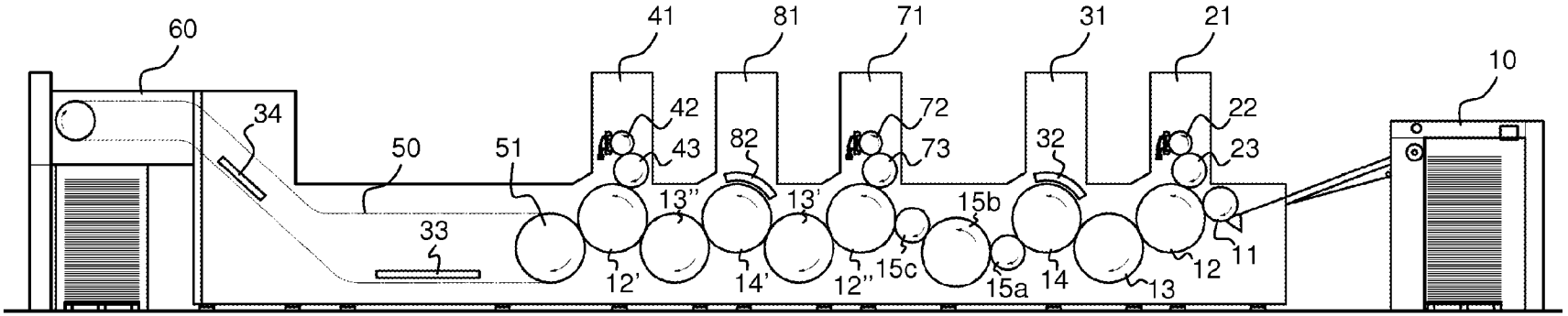
FIG. 4 is a schematic side view of a sheet-fed varnishing machine according to another embodiment of the invention.

It shall be appreciated that additional coating and/or drying/curing towers might be provided. For instance, an additional coating tower and an additional drying/curing tower might be provided upstream of the first or second coating tower to apply a primer. FIG. 4 illustrate an example of such a modification.

In FIG. 4, identical elements are designated by the same reference numerals as in FIG. 3 and fulfil the same purpose. As compared to FIG. 3, the varnishing machine includes an additional coating tower 71 followed by an additional drying/curing tower 81, which towers 71, 81 are located between the perfecting unit 15*a*-15*c* and the coating tower 41.

The additional coating tower 71 is similar to the first and second coating towers 21, 41 and comprises a similar flexographic coating unit with an anilox roller 72 and flexographic forme cylinder 73. As mentioned, this coating unit might be used to apply a primer on the second side of the sheets before the application of the varnish in the coating tower 41, the primer being suitably dried/cured by the drying/curing system 82 in the additional drying/curing tower 81. Obviously, a similar arrangement might be provided upstream of the first coating tower 21 for applying and drying/curing a primer on the first side of the sheets.

Additional drums and cylinders are further provided to suitably transport the sheets through the additional towers 71, 81, namely second and third transfer drums 13', 13", a second processing cylinder 14', and a third impression cylinder 12". In FIG. 4, the sheets are thus transferred from the turning drum 15*c* of the perfecting unit to the third impression cylinder 12" which cooperates with the flexographic forme cylinder 73 of the additional coating tower 71, then onto the second transfer drum 13' to be transferred to the second processing cylinder 14' which cooperates with the additional drying/curing system 82, and then onto the third transfer drum 13" before being transferred onto the circumference of the impression cylinder 12' that cooperates with the flexographic forme cylinder 43.

Alternatively, the coating towers 41, 71 might be used to apply a thicker layer of protective varnish on the second side of the sheets (or on the first side of the sheets provided a similar arrangement is envisaged), i.e. in two steps. From a theoretical point of view, the thicker layer of varnish might be applied in any number of steps, i.e. in one, two or more steps.

As already mentioned hereabove, while the invention is particularly advantageous in the context of the varnishing of intaglio-printed security documents, the invention is equally applicable to the varnishing of printed security documents in general, wherein both sides of the security documents are covered by a protective varnish and wherein a first side of the security documents exhibits a surface roughness at least 10 microns higher than that of the second side. Such could in particular be the case of security documents which are printed onto a substrate the manufacturing process of which causes the first side of the security documents to exhibit a higher surface roughness than the second side.

Various modifications and/or improvements may be made to the above-described embodiments without departing from the scope of the invention as defined by the annexed claims. For instance, the varnishing machine according to the invention may exhibit any number of coating units and drying/curing units combined in any desired manner, as long as the overall configuration of the varnishing machine enables the application of a thicker layer of protective varnish on a side of the security documents than on the other.

The invention claimed is:

1. A method for varnishing intaglio-printed security documents, wherein both sides of the security documents are covered by a protective varnish, and wherein the method comprises the step of applying a thicker layer of protective varnish on a side of the security documents which is opposite to the side of the security documents which was last printed by intaglio printing.

2. A method for varnishing printed security documents, wherein both sides of the security documents are covered by a protective varnish, wherein a first side of the security documents exhibits a surface roughness at least 10 microns higher than that of the second side, and wherein the method comprises the step of applying a thicker layer of protective varnish on the first side of the security documents.

3. The method according to claim 2, wherein the security documents are printed onto a substrate the manufacturing process of which causes the first side of the security documents to exhibit a higher surface roughness than the second side.

4. The method according to claim 1, wherein the thicker layer of protective varnish is applied in one step onto the side of the security documents.

5. The method according to claim 1, wherein the thicker layer of protective varnish is applied in two or more steps onto the side of the security documents.

6. The method according to claim 1, wherein both sides of the security documents are varnished in such a way that both sides of the security documents exhibit substantially the same surface roughness after varnishing.

7. The method according to claim 1, comprising the step of applying a primer on at least one side of the security documents before applying the protective varnish.

8. The method according to claim 2, wherein the thicker layer of protective varnish is applied in one step onto the side of the security documents.

9. The method according to claim 2, wherein the thicker layer of protective varnish is applied in two or more steps onto the side of the security documents.

10. The method according to claim 2, wherein both sides of the security documents are varnished in such a way that both sides of the security documents exhibit substantially the same surface roughness after varnishing.

11. The method according to claim 2, comprising the step of applying a primer on at least one side of the security documents before applying the protective varnish.

12. The method according to claim 1, wherein the intaglio printed security documents are intaglio-printed banknotes.

13. The method according to claim 2, wherein the printed security documents are banknotes.

14. The method according to claim 4, wherein the thicker layer of protective varnish is applied by means of a varnishing machine comprising a first coating unit for varnishing a front side of the security documents in one step and a second coating unit for varnishing a back side of the security documents in one step, the first or second coating unit being designed to apply the thicker layer of protective varnish in one step.

15. The method according to claim 8, wherein the thicker layer of protective varnish is applied by means of a varnishing machine comprising a first coating unit for varnishing a front side of the security documents in one step and a second coating unit for varnishing a back side of the security documents in one step, the first or second coating unit being designed to apply the thicker layer of protective varnish in one step.

16. The method according to claim 5, wherein the thicker layer of protective varnish is applied by means of a varnishing machine comprising a first coating unit for varnishing a front side of the security documents and a second coating unit for varnishing a back side of the security documents, the varnishing machine further comprising at least a third coating unit for applying an additional layer of protective varnish on the front or back side of the security documents.

17. The method according to claim 9, wherein the thicker layer of protective varnish is applied by means of a varnishing machine comprising a first coating unit for varnishing a front side of the security documents and a second coating unit for varnishing a back side of the security documents, the varnishing machine further comprising at least a third coating unit for applying an additional layer of protective varnish on the front or back side of the security documents.

18. The method according to claim 7, wherein the thicker layer of protective varnish is applied by means of a varnishing machine comprising a first coating unit for varnishing a front side of the security documents and a second coating unit for varnishing a back side of the security documents, the varnishing machine further comprising at least a third coating unit for applying the primer on the front or back side of the security documents.

19. The method according to claim 11, wherein the thicker layer of protective varnish is applied by means of a varnishing machine comprising a first coating unit for varnishing a front side of the security documents and a second coating unit for varnishing a back side of the security documents, the varnishing machine further comprising at least a third coating unit for applying the primer on the front or back side of the security documents.

20. The method according to claim 1, wherein varnishing is performed by flexographic printing.

21. The method according to claim 20, wherein varnishing is performed by means of a varnishing machine comprising a first coating unit for varnishing a first side of the security documents and at least a second coating unit for varnishing the second side of the security documents, each of the first and second coating units including an anilox roller cooperating with a flexographic forme cylinder.

22. The method according to claim 2, wherein varnishing is performed by flexographic printing.

23. The method according to claim 22, wherein varnishing is performed by means of a varnishing machine comprising a first coating unit for varnishing a first side of the security documents and at least a second coating unit for varnishing the second side of the security documents, each of the first and second coating units including an anilox roller cooperating with a flexographic forme cylinder.

* * * * *